US009976755B2

(12) United States Patent
Coyle

(10) Patent No.: US 9,976,755 B2
(45) Date of Patent: May 22, 2018

(54) EXPANSION TANK REMOVAL DEVICE

(71) Applicant: Kenneth G. Coyle, Bow, NH (US)

(72) Inventor: Kenneth G. Coyle, Bow, NH (US)

( * ) Notice: Subject to any disclaimer, the term of this patent is extended or adjusted under 35 U.S.C. 154(b) by 755 days.

(21) Appl. No.: 14/538,093

(22) Filed: Nov. 11, 2014

(65) Prior Publication Data

US 2016/0130036 A1 May 12, 2016

(51) Int. Cl.
*B65D 33/10* (2006.01)
*F24D 3/10* (2006.01)

(52) U.S. Cl.
CPC .... *F24D 3/1008* (2013.01); *F24D 2220/0278* (2013.01)

(58) Field of Classification Search
CPC ..... A45F 5/00; A45F 5/10; A45F 3/14; F24D 3/1008
USPC ..... 220/475; 294/149, 150
See application file for complete search history.

(56) References Cited

U.S. PATENT DOCUMENTS 841,462 A 1/1907 Smith
1,022,409 A 4/1912 Foster
4,586,687 A 5/1986 Ziaylek, Jr.
5,022,624 A 6/1991 Hill
5,344,111 A 9/1994 Gantzert
6,347,730 B1 * 2/2002 Frederick ..... A45F 3/14 224/250
6,520,123 B2 2/2003 Parker et al.
2014/0103130 A1 4/2014 Brown et al.

* cited by examiner

*Primary Examiner* — King M Chu
(74) *Attorney, Agent, or Firm* — Dale J. Ream

(57) ABSTRACT

An expansion tank recovery apparatus for use in extracting a thermal expansion tank includes a container body having a closed bottom wall and an upstanding side wall that together define an interior area configured to selectively receive the expansion tank. A pair of support strap assemblies is coupled to sides of the side wall and extend upwardly. Upper ends include hook portions that are selectively coupled to an overhead fluid pipe to which a thermal expansion tank is coupled. The support assemblies are length adjustable such that the container body is selectively lowered from the hook portions when respective position adjustment mechanisms are actuated and the support assemblies are operatively lengthened. In one embodiment, the position adjustment mechanism is a ratchet strap. In use, the container body may be positioned beneath the expansion tank, the tank disconnected from the pipe, received into the container body, and lowered to the floor.

12 Claims, 11 Drawing Sheets

EXPANSION TANK REMOVAL DEVICE

BACKGROUND OF THE INVENTION

This invention relates to a mechanical device for use with plumbing systems such as expansion tanks and, more particularly, to an apparatus for receiving and containing an expansion tank when disconnected from an elevated mounting position and lowering the expansion tank to the floor. The present invention enables an expansion tank to be disconnected and lowered by a single workman while eliminating the risk of damage and injury that may be caused from the expansion device falling to the floor.

A thermal expansion tank is a small, often cylindrical, tank installed in fluid communication with a hot water heater or boiler system and configured to relieve excessive pressure caused by increased temperatures of heated water. An expansion tank is mounted in close proximity to the water heating reservoir it is intended to protect and, in industrial settings, is often mounted in an elevated position above the floor. Specifically, the expansion tank may be coupled below an overhead pipe to which it may be operatively connected that is in fluid communication with the hot water tank.

A plumber or general facilities worker may be called upon to remove or replace an expansion tank. This task may create a dangerous situation in that disconnecting and dismounting an expansion tank from its elevated position renders the expansion tank free to fall to the floor and potentially damage property or injure the worker. An expansion tank may weigh 30 to 40 pounds and be difficult for a unassisted worker to manage, especially considering the elevated position of the tank which may be mounted above the boiler and electronic controls.

Therefore, it would be desirable to have an expansion tank recovery apparatus that can be mounted to an overhead pipe or other elevated frame structure adjacent the expansion device such that the expansion tank is selectively received into a container body so as to eliminate the risk of the expansion tank falling to the floor when disconnected. Further, it would be desirable to have an expansion tank recovery apparatus that is positionally adjustable to surround an expansion tank and to lower a captured tank toward the floor.

SUMMARY OF THE INVENTION

An expansion tank recovery apparatus for use in extracting a thermal expansion tank according to the present invention includes a container body having a closed bottom wall and an upstanding side wall that together define an interior area configured to selectively receive the expansion tank. A pair of support strap assemblies is coupled to sides of the side wall and extends upwardly. Upper ends of respective support strap assemblies include hook portions that are selectively coupled to an overhead fluid pipe to which a thermal expansion tank is coupled. The support assemblies are length adjustable such that the container body is selectively lowered from the hook portions when respective position adjustment mechanisms are actuated and the support assemblies are operatively lengthened. In one embodiment, the position adjustment mechanism is a ratchet strap. In use, the container body may be positioned beneath the expansion tank, the tank disconnected from the pipe, received into the container body, and lowered to the floor.

Therefore, a general object of this invention is to provide an expansion tank recovery apparatus for use in receiving and lowering a thermal expansion tank when dismounted from an elevated position in relation to a hot water system.

Another object of this invention is to provide an expansion tank recovery apparatus, as aforesaid, having support strap assemblies for suspending a container body beneath the expansion tank so as to receive the tank therein when disconnected.

Still another object of this invention is to provide an expansion tank recovery apparatus, as aforesaid, in which the support strap assemblies are length adjustable such that the container body may be moved upwardly to capture the expansion tank and move downwardly to the floor for disposal or repair.

Yet another object of this invention is to provide an expansion tank recovery apparatus, as aforesaid, that enables a single worker to capture and remove an expansion tank without assistance by another worker.

A further object of this invention is to provide an expansion tank recovery apparatus, as aforesaid, in which the container body is constructed of a flexible and durable material.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

An expansion tank recovery apparatus and method of use according to a preferred embodiment of the present invention will now be described with reference to FIGS. 1 to 9 of the accompanying drawings. The expansion tank recovery apparatus 10 includes a container body 20 and a pair of length adjustable support strap assemblies 30.

Figure 1:
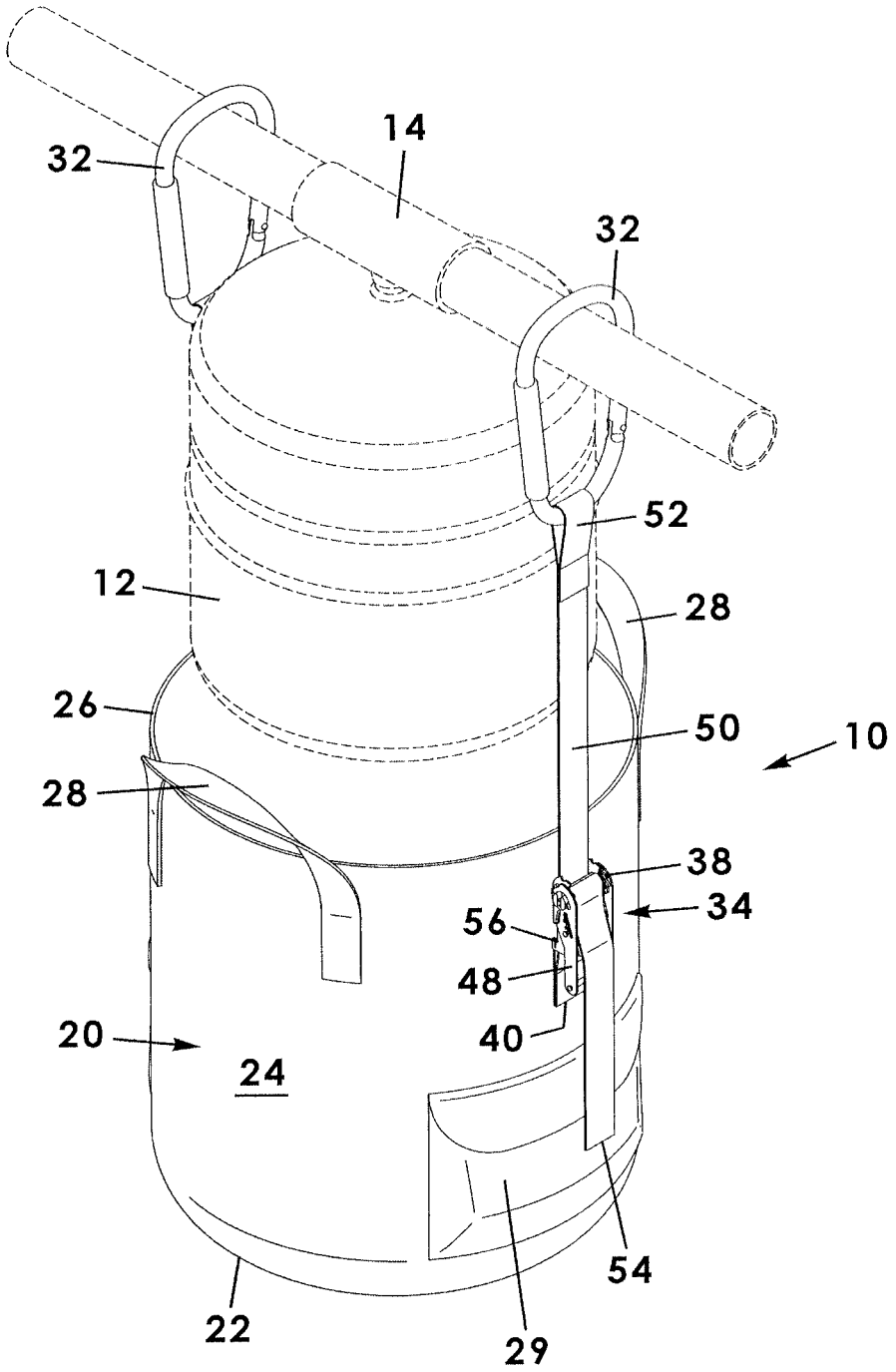
FIG. 1 is a perspective view of an expansion tank recovery apparatus according to a preferred embodiment of the present invention, illustrated in use being suspended from an overhead fluid pipe and positioned to recover a thermal expansion tank.

The container body 20 includes a closed bottom wall 22 and a side wall structure extending upwardly from a peripheral edge or edges of the bottom wall 22 (FIG. 1). Preferably, the upstanding wall structure is a continuous side wall 24 having a generally cylindrical configuration although a container body 20 having a square or rectangular configuration would also work. Together, the bottom wall 22 and side wall 24 define an interior area of suitable dimension to receive a thermal expansion tank 12 therein as will be described in more detail later. Upper edges of the side wall 24 define an open top 26 in communication with the interior area and that provides access to the interior area. Preferably, the material used for constructing the container body 20 is duck cloth, canvas, or other durable material suitable for commercial utility applications.

The container body 20 includes a pair of spaced apart handles 28. Each handle 28 is coupled to an exterior surface of the side wall 24 at or adjacent upper edges of the side wall 24. The handles 28 are constructed of a heavy material and are connected to the side wall 24 in a durable manner such that the container body 20 may be picked up and carried (along with an expansion tank 12 therein).

A pocket 29 or pouch is situated on an exterior surface of the side wall 24 of the container body 20. The pocket 29 is configured to hold straps, hooks, and other components of the strap assemblies 30 of the present invention that will be described later. The pocket 29 may include an opening selectively covered by a flap.

The expansion tank recovery apparatus 10 includes a pair of support strap assemblies 30 configured to suspend the container body 20 from an overhead pipe or other frame structure to which a thermal expansion tank 12 is mounted. The pair of support strap assemblies 30 is coupled to opposed sides of the side wall 24 and extend upwardly. Upper ends of the support strap assemblies 30 include hook portions 32 that are selectively coupled to the overhead fluid pipe 14 to which the thermal expansion tank 12 is coupled. The support assemblies 30 are length adjustable such that the container body 20 may be selectively lowered from the hook portions 32 when respective position adjustment mechanisms 34 are actuated and the support assemblies 30 are operatively lengthened.

Figure 2:
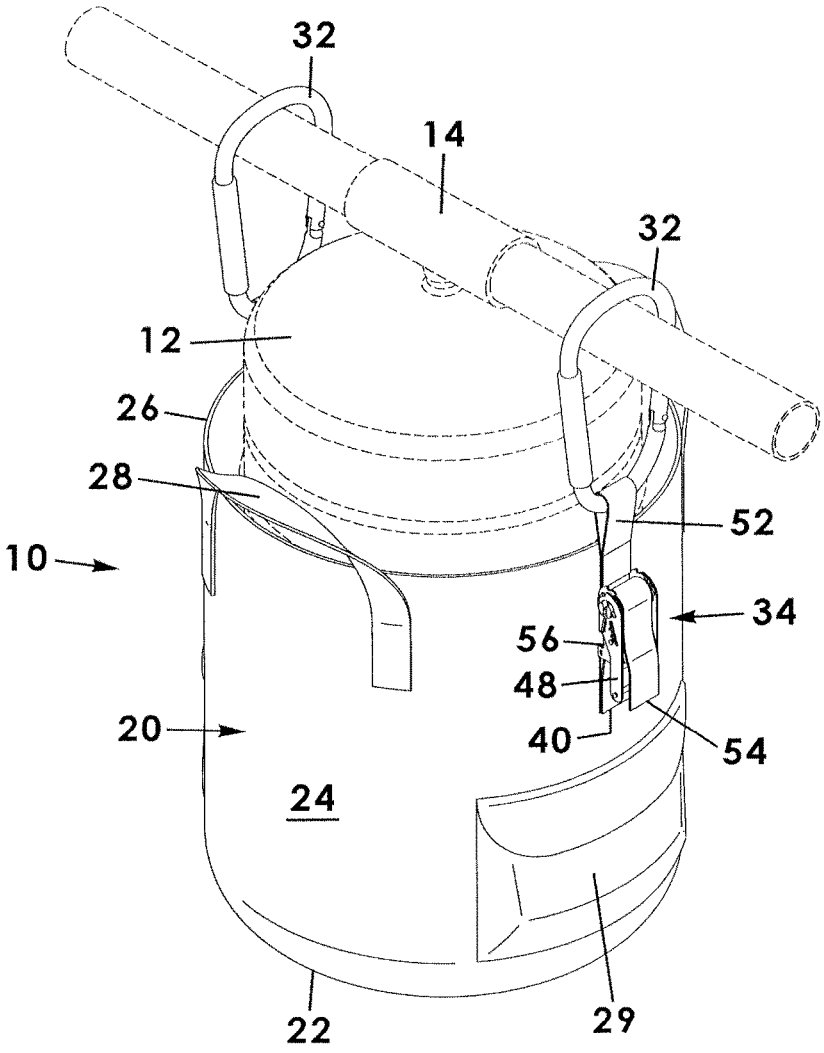
FIG. 2 is another perspective view of the expansion tank recovery apparatus as in FIG. 1, illustrated receiving the expansion tank into an interior area of a container body.

More particularly, each support strap assembly 30 includes a hook portion 32 configured to be selectively coupled to an overhead fluid pipe 14, mounting bracket, or other structural framework to which an expansion tank 12 is attached (FIGS. 1 and 2). It is understood that the pipe 14 or other hardware in use with the present invention may be in fluid communication with the expansion tank 12 or just in close proximity therewith. Preferably, the hook portion 32 is a carabiner fastener in that a carabiner is circuitous once attached and cannot be inadvertently detached—which in the present instance could cause harm or damage by a falling expansion tank. However, a hook portion 32 may include a traditional hook, clasp, wire loop, or other suitable fastener.

Each support strap assembly 30 also includes a position adjusting mechanism 34 that is configured to move the container body 20 closer to or farther from the hook portion 32 in order to capture the expansion tank 12 into the interior area and then to lower the apparatus 10 to the floor. The position adjusting mechanism 34 has a first end 36 operatively coupled to the side wall 24 of the container body 20 and a second end 38 opposite the first end 36. Preferably, the pair of strap assemblies 30 is coupled to opposite sides of the side wall 24. Specifically, each support strap assembly 30 includes a short strap 40 having a proximal end 42 fixedly attached to the side wall 24 of the container body 20 and a distal end 44 coupled to the first end 36 of the position adjusting mechanism 34.

The position adjusting mechanism 34 defines an intake opening 46 adjacent the second end 38 thereof that is configured to receive an end of a strap as will be described below. The position adjusting mechanism 34 also includes an actuation member 48 situated adjacent the second end 38, the actuation member 48 being rotatably or pivotally coupled thereto. An elongate strap 50 includes a first end 52 coupled to the hook portion 32 and a second end 54 extending into the intake opening 46 of a respective position adjusting mechanism 34. The actuation member 48 is configured to incrementally draw the elongate strap 50 into the position adjusting mechanism 34 upon pivotal movement of the actuation member 48 or, when operation of the actuation member 48 is released, to incrementally move the elongate strap 50 away from the position adjusting mechanism 34 as will be further described later.

In an embodiment, the position adjusting mechanism 34 may be a ratchet tie-down device having a ratchet body 56 configured to tighten a strap extending between the ratchet body 56 and another object. In the present instance, operation of the ratchet tie-down device tightens (or pulls) the ratchet body 56 (and the container body 20 coupled to the ratchet body 56 toward the respective hook portion 32 that is coupled to the overhead pipe 14. Even more specifically, the second end 54 of the elongate strap 50 is selectively received into the intake opening 46 and is incrementally drawn further into the ratchet body 56 upon pivotal movement of the actuation member 48 and may interact with a reel 58, the actuation member 48 being a lever arm pivotally coupled to the second end 38 of the ratchet body 56. As the elongate strap 50 is moved into the ratchet body 56, the ratchet body 56 moves upwardly along the elongate strap 50, this movement moving the entire container body 20 upwardly toward the hook portions 32 that are coupled to the overhead pipe 14 (compare FIG. 1 to FIG. 2). Preferably, the elongate strap 50 is about 4 feet long such that it can facilitate lowering the container body 20 downwardly from a considerable height above a floor surface.

In an embodiment, the ratchet body 56 includes a reel 58 pivotally or rotatably mounted proximate the second end 38 of the position adjustment assembly/ratchet body 56 and configured to rotate when the lever arm is pivotally moved. In other words, the reel 58 is operably coupled to the actuation member 48. In use, the second end 54 of the elongate strap 50 may be threaded through the reel 58 and extended through the first end 36 of the position adjustment assembly 34 The strap 50 is tightened around the reel 58 as the reel 58 is operated by the actuation member 48.

Figure 3A:
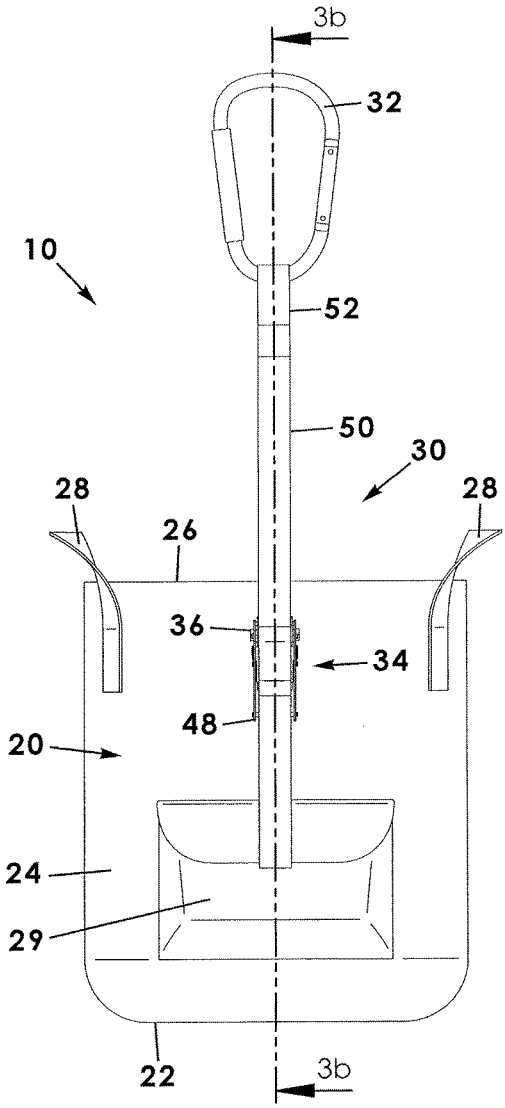
FIG. 3*a* is a side view of the expansion tank recovery apparatus as in FIG. 2.
Figure 3B:
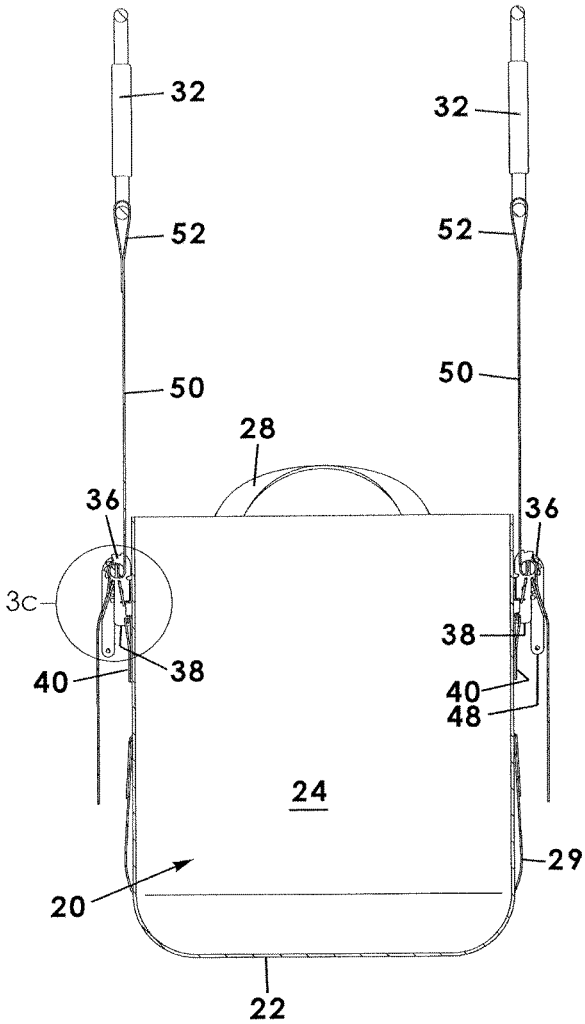
FIG. 3*b* is a section view taken along line 3*b*-3*b* of FIG. 3*a;*
Figure 3C:
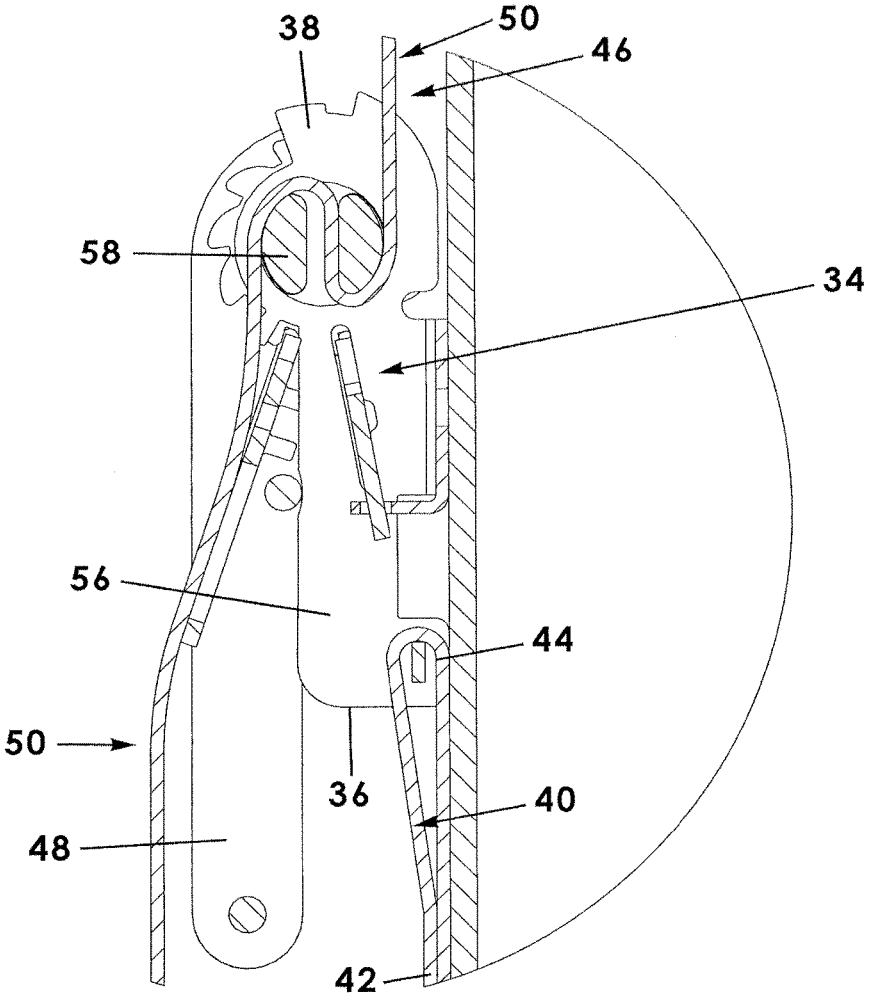
FIG. 3*c* is an isolated view on an enlarged scale taken from FIG. 3*b;*
Figure 3D:
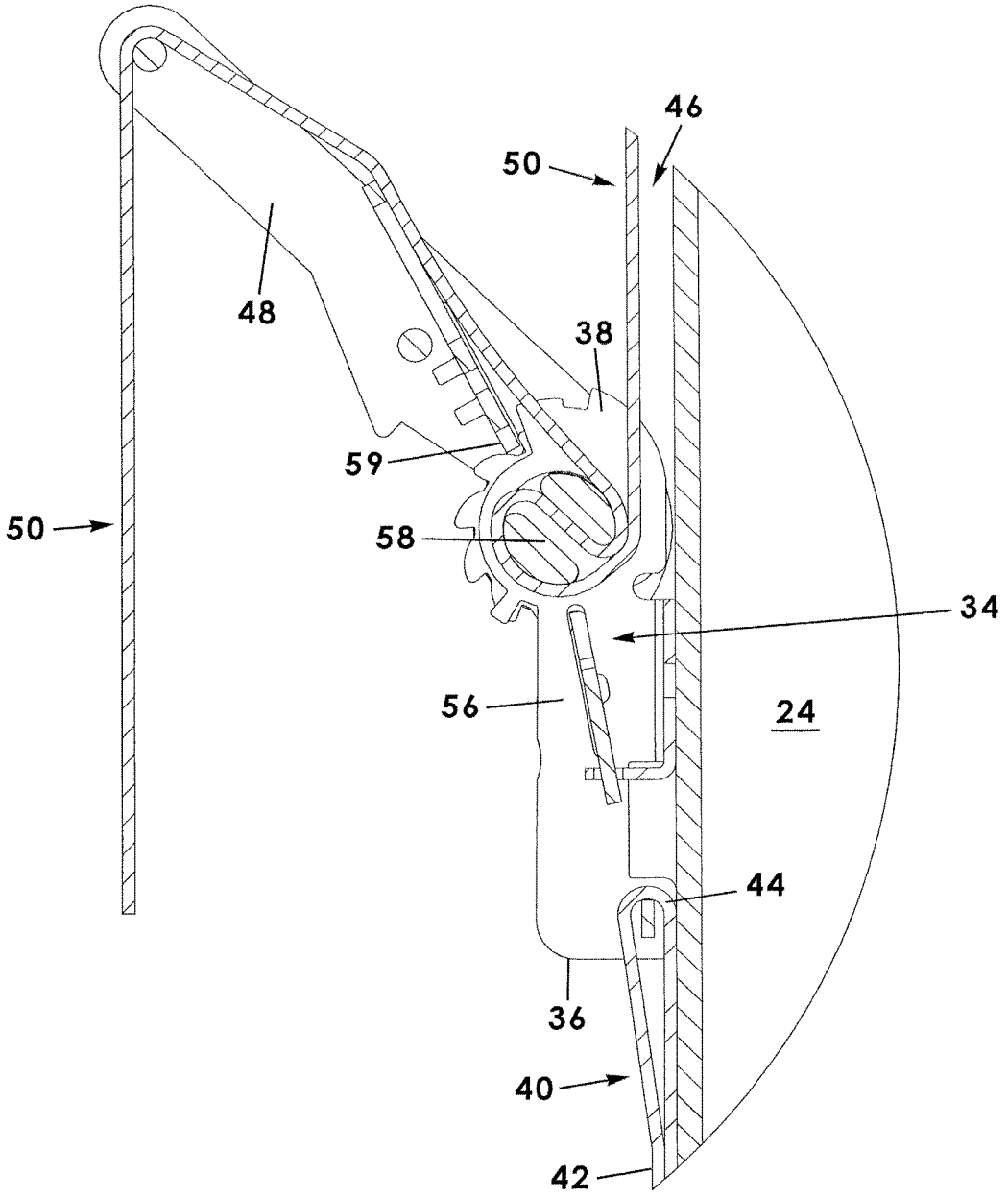
FIG. 3*d* is an isolated view on an enlarged scale as in FIG. 3*c* illustrating operation of the actuation member.
Figure 4A:
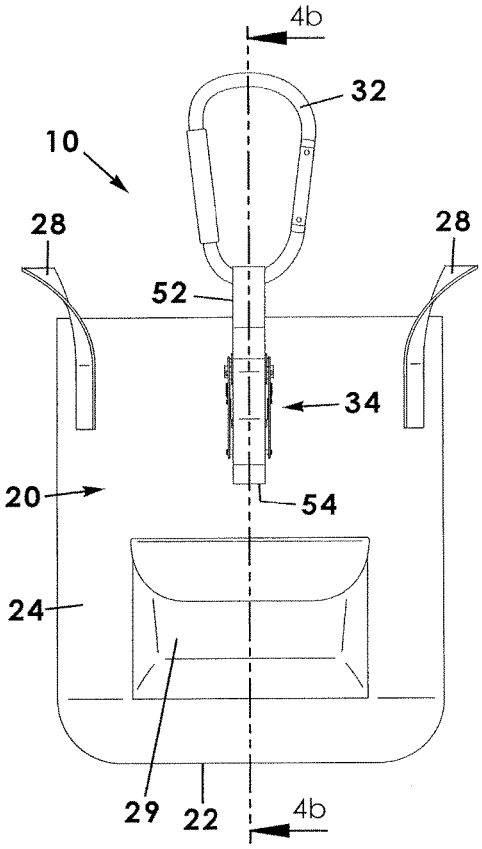
FIG. 4*a* is a side view of the expansion tank recovery apparatus as in FIG. 2.
Figure 4B:
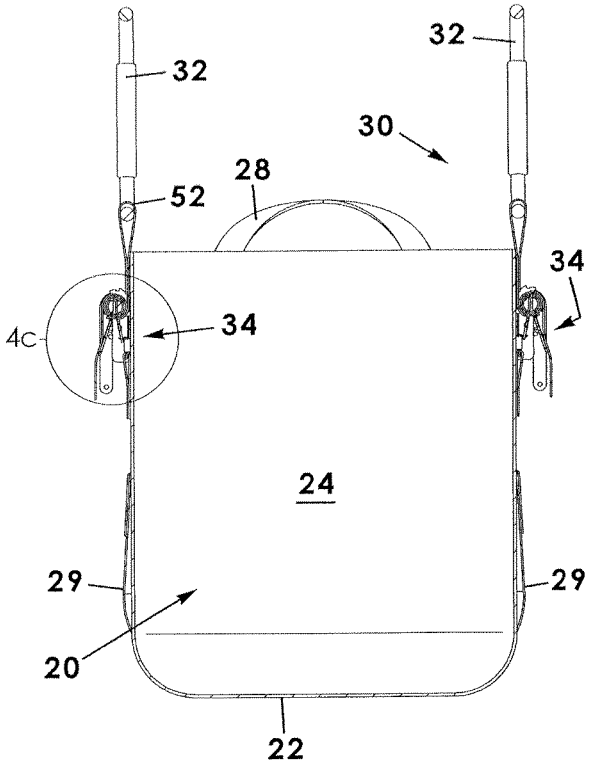
FIG. 4*b* is a section view taken along line 4*b*-4*b* of FIG. 4*a;*
Figure 4C:
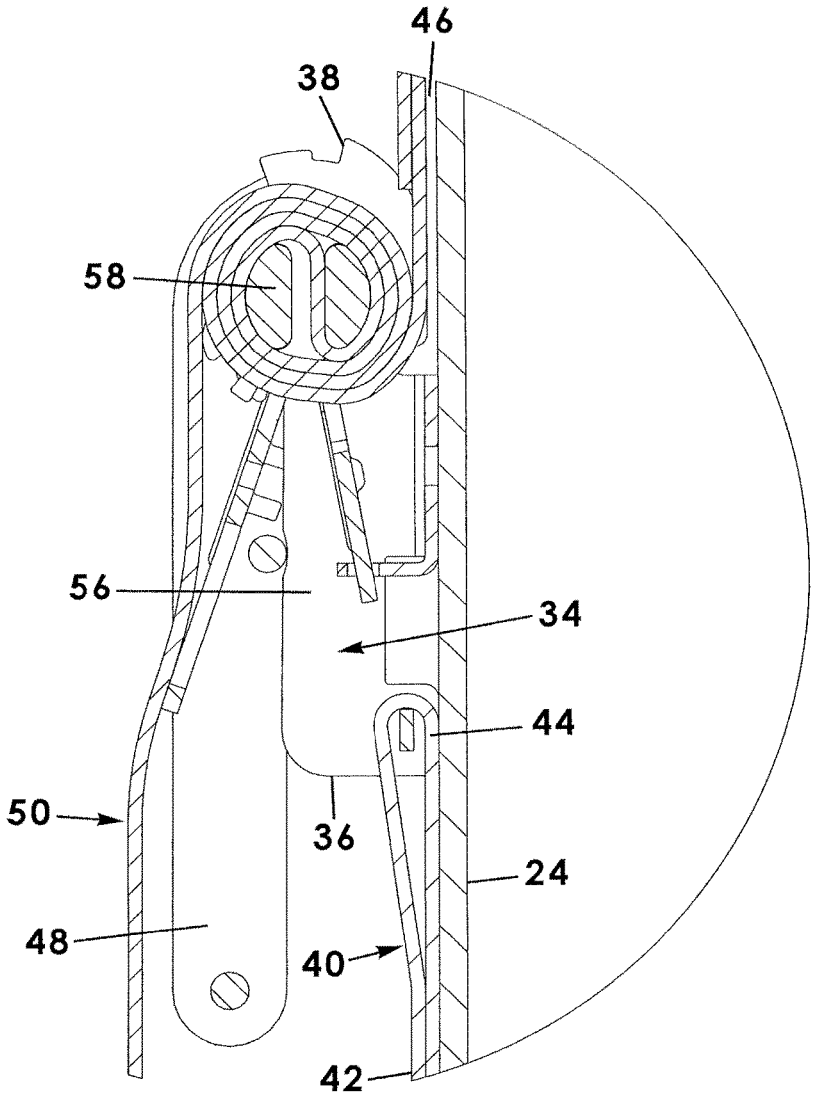
FIG. 4*c* is an isolated view on an enlarged scale taken from FIG. 4*b;*
Figure 5:
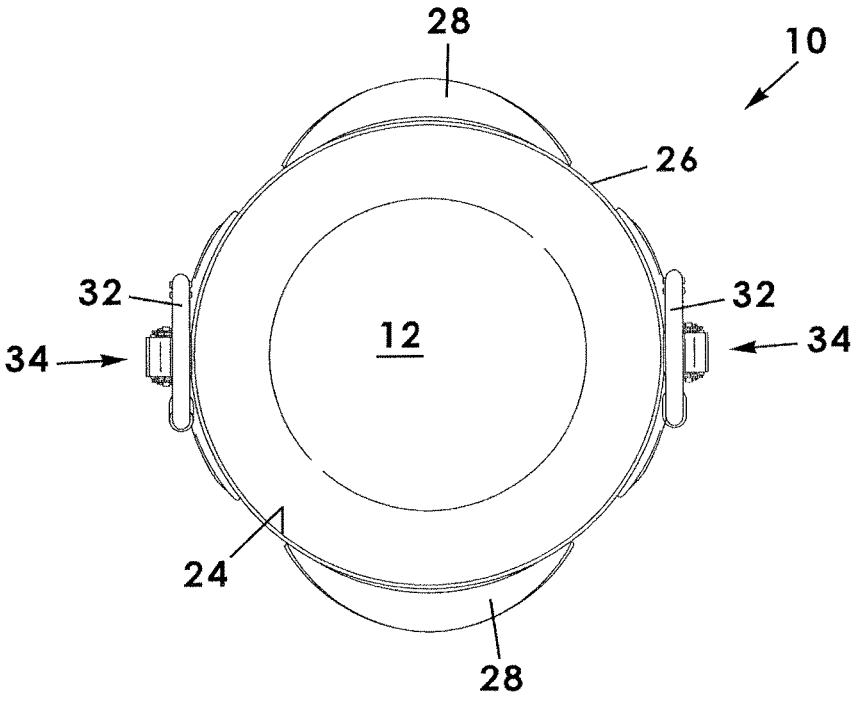
FIG. 5 is a top view of the expansion tank recovery apparatus as in FIG. 2.

As shown in FIGS. 3*c*, 3*d*, and 4*c*, the strap 50 is threaded through the reel 48 in a manner that enables both an upper portion and lower portion of the strap 50 to be wound about the reel 48 upon operation of the actuation member 48 (as the position adjustment assembly 34 is moved closer to the hook portion 32). As shown in FIGS. 1 and 2, the elongate strap 50 extends an increasingly shorter distance both above and below the ratchet body 56 as the ratchet body 56 and container body 20 are moved upwardly toward the hook portions 32 and overhead pipe 14. In other words, as the upper portion of the strap 50 is wound, the entire ratchet body 56 is drawn upwardly toward the hook portion 32 since the hook portion 32 is coupled to the fixed object, e.g. the pipe 14. By contrast, both the upper portion and lower portion of the elongate strap 50 are unwound from the reel 48 and appear "longer" above and below the ratchet body 56 when the elongate strap 50 is released to allow the container body 20 to move downward from the pipe 14 (FIG. 1).

The position adjusting mechanism 34 may include a release member 59 that is configured to reverse the direction of movement of the elongate strap 50 relative to the strap intake opening 46 (FIG. 3*d*). In other words, when the release member 59 is actuated, the elongate strap 50 is released from a ratcheting movement and is allowed to "slip" in an opposite direction than the strap 50 is otherwise moved by operation of the actuation member 48 and reel 58. In use, operation of the release member 59 enables a user to control a descending movement of the container body 20 from an elevated position toward the floor.

Figure 6:
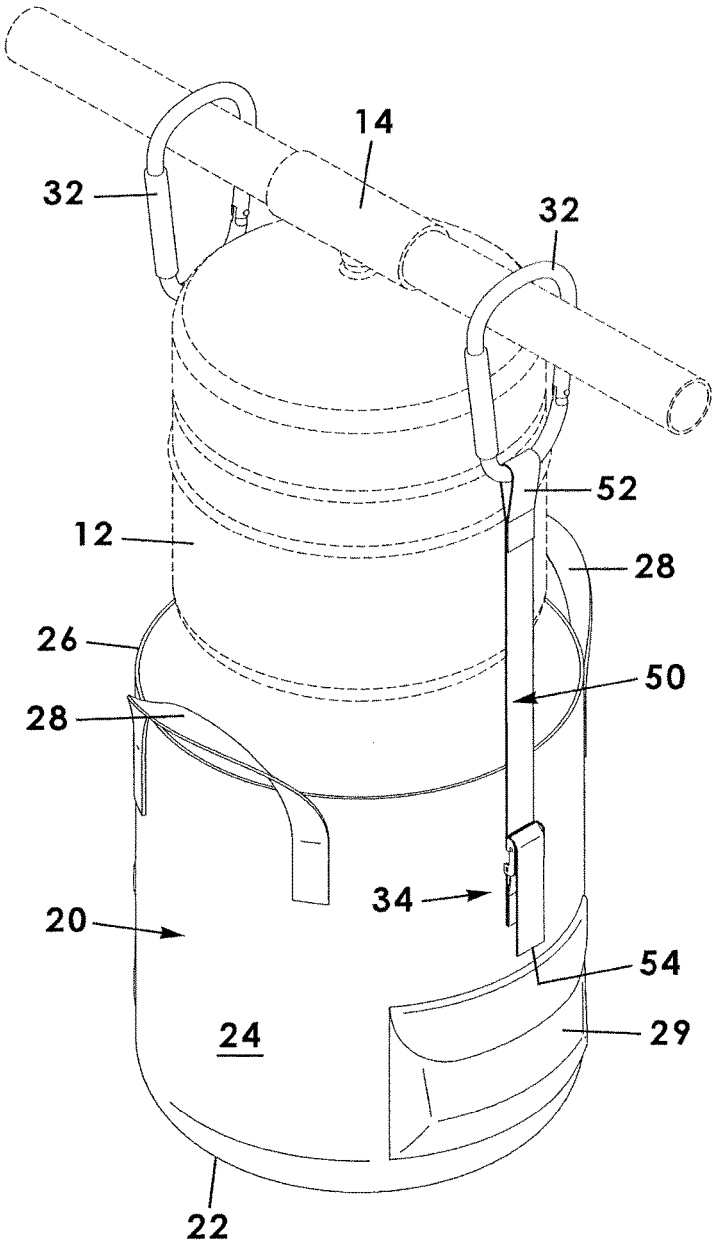
FIG. 6 is a perspective view of the expansion tank recovery apparatus as in FIG. 1 according to another embodiment of the present invention illustrated in position to recover a thermal expansion tank.
Figure 7:
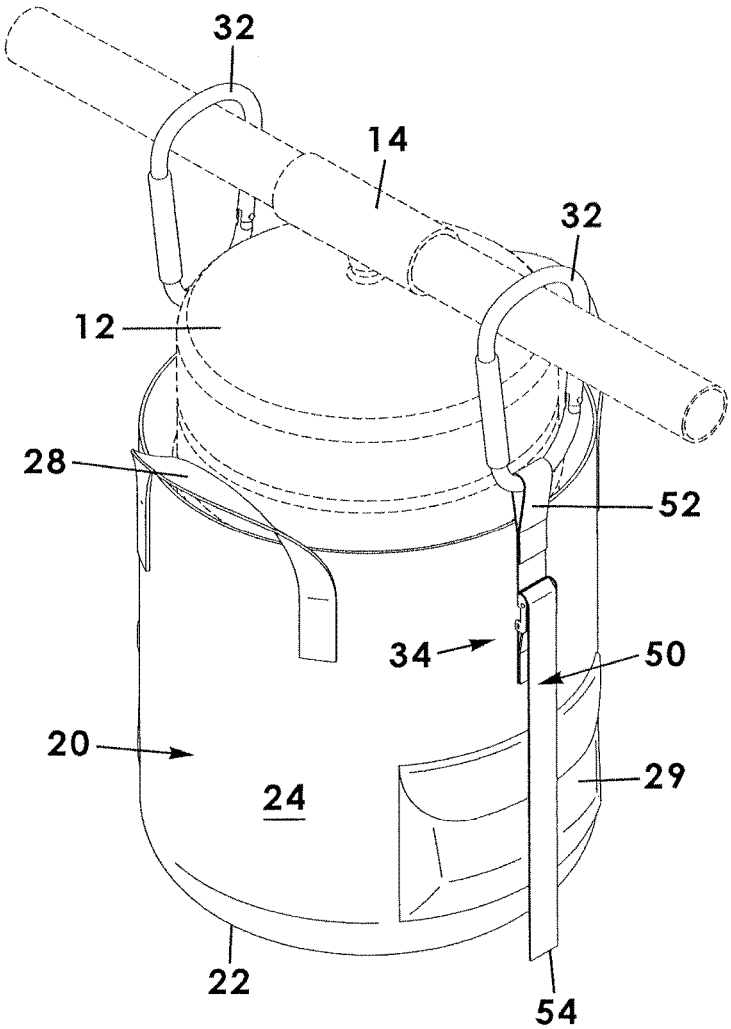
FIG. 7 is another perspective view of the expansion tank recovery apparatus as in FIG. 6, illustrated receiving the expansion tank into an interior area of a container body.
Figure 8:
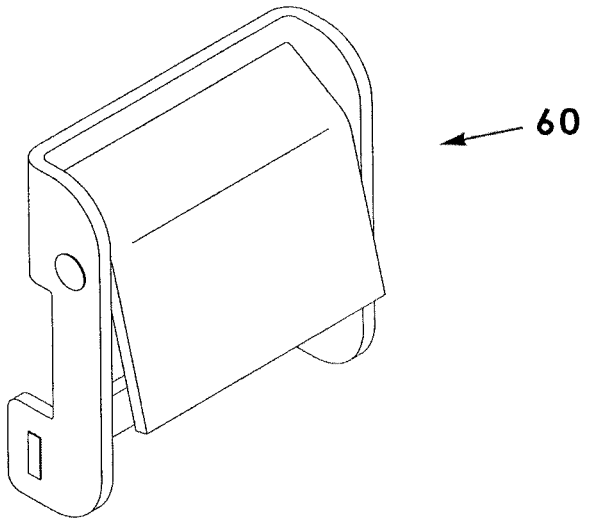
FIG. 8 is an isolated view of a thumb clamp removed from the apparatus shown in FIG. 7, the clamp illustrated in a locked or tightened configuration.
Figure 9:
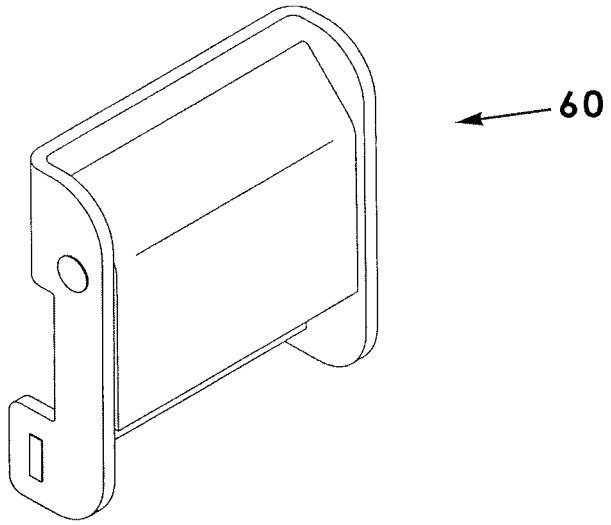
FIG. 9 is another isolated view of the thumb clamp as in FIG. 8 illustrated in a released configuration.

In an alternative embodiment shown in FIGS. 6-9, each position adjusting mechanism 34 may include a thumb clamp 60 through which the elongate strap 50 may extend. The thumb clamp 60 defines an open passage through which to receive the elongate strap 50. The thumb clamp is movable between a tightened configuration (FIG. 8) that does not allow movement or passage of the elongate strap 50 so as to hold the container body 20 steady (FIG. 7) and a relaxed configuration (FIG. 9) that allows the elongate strap 50 to pass therethrough such as to facilitate a lowering of the container body 20 with extension tank 12 therein toward a floor position (FIG. 6).

In use, a workman such as a plumber may be called upon to remove or replace a thermal expansion tank from a commercial facility. As expansion tanks are often mounted at elevated configurations within an industrial facility, the workman who is working alone must formulate a strategy for disconnecting and dismounting the expansion tank and lowering it to the floor for disposal, repair, or replacement—not an easy task given the considerable weight, awkward configuration, and potential for damage or injury. Accordingly, the expansion tank recovery apparatus 10 described above and method of use discussed below may be employed to successfully complete this task.

Specifically, the hook portions 32 respective support strap assemblies 30 may be coupled to the overhead pipe 14 or other frame structure proximate the expansion tank 12 (FIG. 1). In this manner, the open top 26 and interior area defined by the container body 20 are positioned as directly beneath the expansion tank as possible. To avoid the expansion tank 12 falling a distance into the container body 20 when disconnected from the overhead pipe 14, the support strap assemblies 30 may be adjusted and moved upwardly as described above, such as by pivotally operating the respective actuation members 48 in a ratcheting manner. This enables the expansion tank 12 to be substantially received into the interior area (FIG. 2). The expansion tank 12 may then be uncoupled from the overhead pipe 14 and received into the container body 20 without worry of it falling or causing injury to the worker. Then, the respective position adjusting mechanisms 34 may be released and operated to lower the container body 20 to the floor or at least to a lower level so as to be recovered safely by the worker, as described above.

It is understood that while certain forms of this invention have been illustrated and described, it is not limited thereto except insofar as such limitations are included in the following claims and allowable functional equivalents thereof.

The invention claimed is:

1. An expansion tank recovery apparatus for use in extracting a thermal expansion tank from an overhead fluid pipe, comprising:

a container body having a closed bottom wall and a continuous side wall extending upwardly therefrom that together define an interior area configured to selectively receive the expansion tank therein;

a pair of length adjustable support strap assemblies coupled to opposed portions of said side wall of said container body, each support strap assembly including:

a hook portion selectively coupled to the overhead fluid pipe;

a position adjusting mechanism having a first end operatively coupled to said side wall of said container body with a short strap and a second end opposed from said first end of said position adjusting mechanism that is operatively connected to said hook portion with an elongate strap; and a pair of handles coupled to said continuous side wall, said pair of handles being spaced apart from one another and adjacent said open top;

wherein said position adjusting mechanism is configured to selectively move along said elongate strap toward or away from said hook portion when actuated.

2. The expansion tank recovery apparatus as in claim 1, wherein:

said short strap includes a proximal end fixedly attached to a respective opposed portion of said side wall structure and a distal end coupled to said first end of said position adjusting mechanism;

said position adjusting mechanism includes an intake opening at said second end and an actuation member operatively coupled to said position adjusting mechanism adjacent said second end;

said elongate strap includes a first end coupled to said hook portion and a second end extending into said intake opening of said position adjusting mechanism, said actuation member configured to draw said elongate strap into said strap intake opening in a stepwise movement when said actuation member is operated such that said position adjusting mechanism is moved incrementally closer to said hook portion when said actuation member is pivotally operated.

3. The expansion tank recovery apparatus as in claim 2, wherein said position adjusting mechanism includes a release mechanism configured to reverse a direction of movement of said elongate strap relative to said strap intake opening.

4. The expansion tank recovery apparatus as in claim 1, wherein said hook portion is a carabiner fastener.

5. The expansion tank recovery apparatus as in claim 1, wherein said continuous side wall includes a pocket configured to store said support strap assemblies when not in use.

6. An expansion tank recovery apparatus for use in extracting a thermal expansion tank from an overhead fluid pipe, comprising:

a container body having a closed bottom wall and a side wall structure extending upwardly from said bottom wall, said bottom wall and said side wall structure defining an interior area configured to selectively receive the expansion tank therein;

a pair of support strap assemblies operatively coupled to opposed portions of said side wall structure of said container body, each support strap assembly including:

a hook portion selectively coupled to the overhead fluid pipe;

a ratchet body having opposed first and second ends, said ratchet body having a reel pivotally mounted at said second end and a lever arm operatively coupled to said reel, said reel being rotated in a ratcheting movement when said lever arm is operated;

a short strap having a proximal end fixedly attached to said respective portion of said side wall structure and a distal end coupled to said first end of said ratchet body; and an elongate strap having a first end coupled to said hook portion and a second end extended through said reel and configured to be wound thereabout such that said ratchet body is moved incrementally closer to said hook portion when said lever arm is pivotally operated.

7. The expansion tank recovery apparatus as in claim 6, wherein said ratchet body includes a release mechanism configured to allow said elongate strap to move away from said hook portion.

8. The expansion tank recovery apparatus as in claim 7, wherein said hook portion is a carabiner fastener.

9. The expansion tank recovery apparatus as in claim 7, wherein said side wall structure is a continuous side wall having a cylindrical configuration complementary to a configuration of the expansion tank.

10. The expansion tank recovery apparatus as in claim 6, wherein said side wall structure is a continuous side wall having a cylindrical configuration complementary to a configuration of the expansion tank.

11. The expansion tank recovery apparatus as in claim 9, comprising a pair of handles coupled to said continuous side wall, said pair of handles being spaced apart from one another and adjacent said open top.

12. The expansion tank recovery apparatus as in claim 11, comprising a pocket situated on an exterior surface of said continuous side wall, said pocket being configured to store said support strap assemblies when not in use.

* * * * *